United States Patent [19]

Canale et al.

[11] 4,187,029

[45] Feb. 5, 1980

[54] APPARATUS AND METHOD FOR PREPARING LITHOGRAPHIC FOUNTAIN SOLUTION

[76] Inventors: Ralph D. Canale, 11-09 43rd Rd., Long Island City, N.Y. 11101; Albert S. Canale, 226-27 B Kingsbury Ave., Bayside, N.Y. 11364

[21] Appl. No.: 931,988

[22] Filed: Aug. 8, 1978

[51] Int. Cl.[2] ..... B01F 3/12; B01F 13/00; B01F 15/02

[52] U.S. Cl. ..... 366/153; 366/167; 366/190; 366/192; 366/262

[58] Field of Search ..... 366/136, 159, 153, 163, 366/165, 173, 176, 262, 167, 190, 192; 423/658.5

[56] References Cited

U.S. PATENT DOCUMENTS

| | | | |
|---|---|---|---|
| 1,737,609 | 12/1929 | Nielsen | 366/153 |
| 1,777,646 | 10/1930 | Klein et al. | 366/136 |
| 2,906,607 | 9/1959 | Jamison | 366/165 X |
| 3,425,669 | 2/1969 | Gaddis | 366/153 |
| 3,762,689 | 10/1973 | Hege | 366/136 |
| 4,007,921 | 2/1977 | Zingg | 366/136 X |
| 4,097,026 | 6/1978 | Haindl | 366/165 |

*Primary Examiner*—Christopher K. Moore

*Attorney, Agent, or Firm*—Curtis, Morris & Safford

[57] ABSTRACT

An apparatus for making a liquid solution from a mixture of a dry powder formulation and a liquid which is particularly useful for making a fountain solution for lithographic printing operations including pump means and circulation means to maintain confined liquid in an agitated state, to completely dissolve a dry powder formulation and to sustain ingredients which dissolve in water at different rates.

14 Claims, 4 Drawing Figures

APPARATUS AND METHOD FOR PREPARING LITHOGRAPHIC FOUNTAIN SOLUTION

BACKGROUND OF THE INVENTION

This invention relates to an apparatus and method for dissolving a dry powder formulation in a liquid to form a solution. More particularly, the invention relates to an apparatus and method for circulating and agitating a solution used as a fountain solution in lithographic printing operations so as to ensure that a powder formulation is completely dissolved and remains in solution even while the solution is being dispensed from the apparatus.

Such a dry powder formulation used in lithographic fountain solutions has been delevoped by Canale et al. and is the subject of a related copending application, Ser. No. 890,018 filed Mar. 24, 1978, the disclosure of which is hereby incorporated by reference.

In lithographic printing processes, such as in lithographic printing of newspapers, brochures and the like, fountain solutions are used in the lithographic presses to replenish the desensitized area of lithographic plates, to clean the surface of the plates and to continuously maintain the non-printing area of such plates water receptive or hydrophilic.

Prior to the dry formulation disclosed in the Canale et al. application, alkali fountain solutions were premixed and shipped to printing sites in drums. Since such solutions are primarily water, the drums were heavy, bulky and difficult to handle. Furthermore, shipping costs for the drums were high. With the development of the dry powder formulation, which eliminates the high shipping costs and the bulky and heavy drums, a safe, simple and efficient apparatus and method for preparing the fountain solution at the printing site was needed.

SUMMARY

The present invention which relates to a continuous pumping and circulating system ensures that the dry formulation is completely dissolved in water and is maintained in an agitated and dissolved state. Furthermore, since the dry formulation contains substances which dissolve at different rates, the continuous agitation of the solution ensures that the solution remains uniformly mixed while the solution is being dispensed from the mixing container. Thus, one using the solution can expect the solution to have a uniform strength each time the solution is dispensed from the mixing container.

One general object of the invention, therefore, is to provide a simple, safe and efficient apparatus and method for dissolving dry substances in a contained liquid.

More specifically, it is an object of the invention to provide a simple, safe and efficient system for dissolving a dry powder formulation in water to provide an alkali fountain solution for use in lithographic printing.

Another object is to provide a system which continuously agitates and circulates the solution while the solution is being dispensed for use.

A further object is to provide a system which can agitate and circulate a solution in both a concurrent and countercurrent manner.

A still further object is to provide a single pumping and circulation system which can dissolve a dry substance in a liquid and dispense the resulting solution.

In one illustrative embodiment of the present invention, the system includes a suction pump, such as a sump pump, which draws the mixture of the liquid and dry substance from a mixing container and pumps the mixture out through a number of arms back into the mixing container thus circulating and agitating the mixture and promoting the dissolution of the dry substance in the liquid.

In accordance with one feature of the invention, the suction pump is mounted in the bottom of the mixing container. As the mixture or solution is drawn into the pump inlet, it is pumped into a manifold connected to the pump outlet and then through a plurality of arms attached to the manifold and out into the mixing container. The arms are arranged so that the fluid passing through the arms and back into the mixing container is directed to create a concurrent or countercurrent flow in the container. Furthermore, an additional outlet may be provided in the manifold for dispensing the solution from the mixing container.

In accordance with further features of some embodiments of the invention, the manifold extends vertically from the pump up into the solution and the arms are rotatable in a generally vertical plane. This construction is advantageous in that the arms may be rotated to different positions inside the mixing container depending on the height and width of the mixing container. Furthermore, the arms may also be directed to a vertical position which facilitates storage of the pump assembly in a minimal amount of space.

In accordance with several important arrangements of the invention, the mixing container is provided with an opening through which liquid can enter the container. By utilizing a float control shutoff valve in conjunction with the opening, a predetermined quantity of liquid may be metered into the mixing container. Thus, by using premeasured packages or cartridges of the dry formulation, the solution strength can be accurately determined and maintained.

The foregoing and other objects, features and advantages of the invention will be more readily understood from the following description of certain preferred embodiments, when read in conjunction with the accompanying drawings.

DESCRIPTION OF CERTAIN PREFERRED EMBODIMENTS

Figure 2:
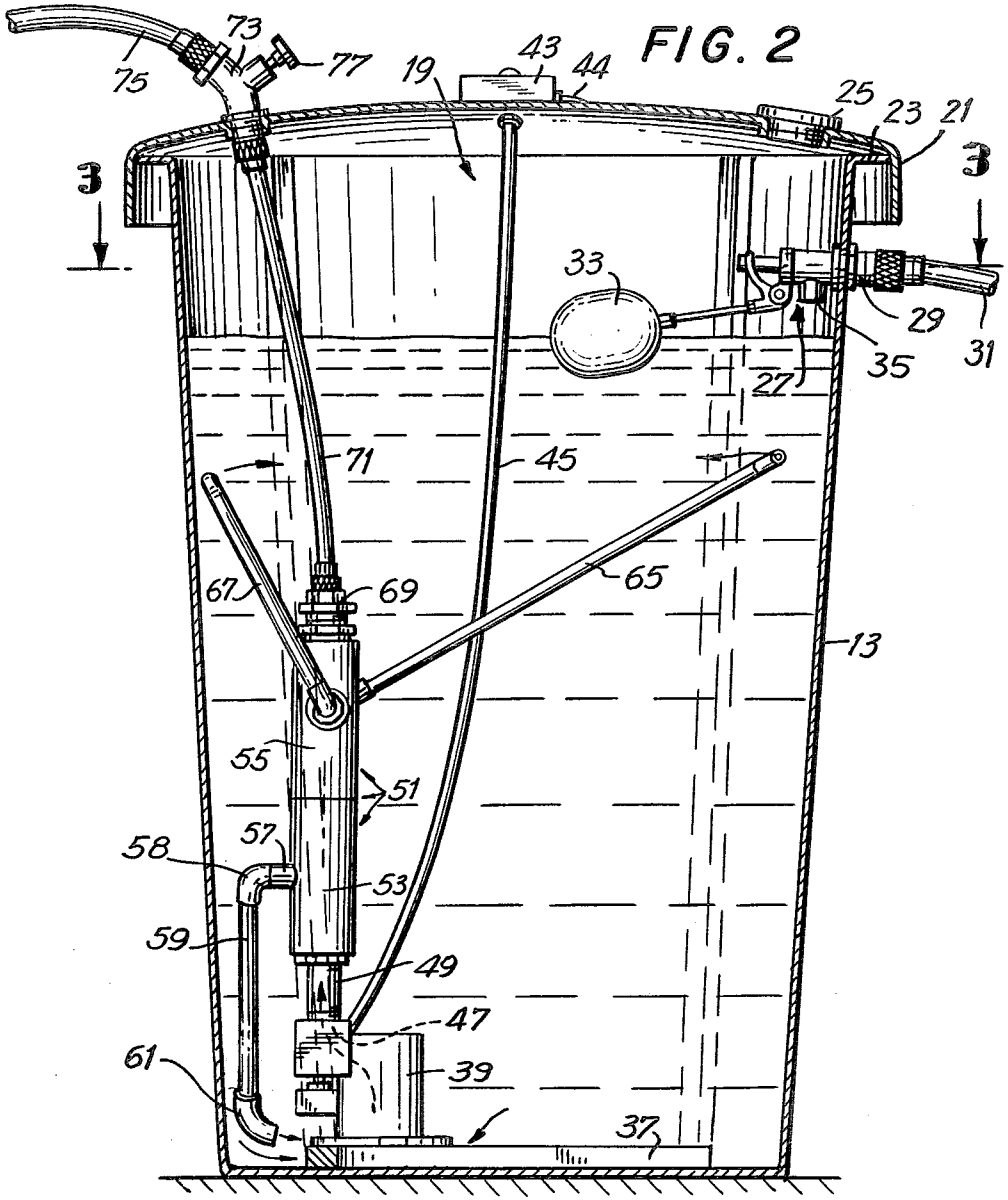
FIG. 2 is a front cross-sectional view of the drum and apparatus, taken along line 2—2 of FIG. 1.
Figure 1:
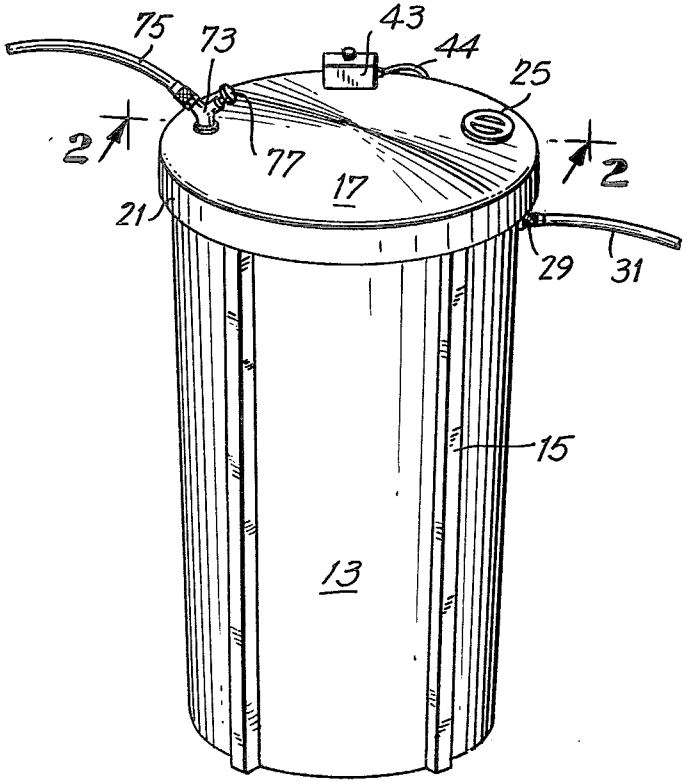
FIG. 1 is an elevational view of the mixing drum which contains the circulation and agitation apparatus.

Referring to FIGS. 1 and 2, a circulation and agitation apparatus 11 is mounted within a mixing drum 13. The drum 13 is generally cylindrically shaped, open at one end and is preferably molded from a plastic material so as to be lightweight. Drum 13 preferably has four equidistant spaced ribs 15 molded in the surface of the drum to add rigidity. Each rib 15 extends from the top to the bottom of the drum and is molded so as to protrude on the outside surface of the drum and forms a channel 16 on the inside of the drum having a transverse cross section which forms three sides of a rectangle. A cover 17 is also provided for the circular opening 19 in the top of drum 13. Cover 17 is generally circular in shape and has a downwardly extending lip 21 to fit over the outer edge surface 23 of opening 19. Cover 17 is also provided with a removeable circular plug which is threadably engaged within cover 17.

In order to precisely control the quantity of liquid introduced into drum 13, a float control valve assembly 27 is provided near the upper end of drum 13. Valve assembly 27 is mounted through the side of drum 13 so that a threaded section 29 protrudes from the exterior surface of drum 13. One end of an input hose 31 is connected to the threaded section 29 and the other end of hose 31 is connected to a water source (not shown). Valve assembly 27 includes a pivotally mounted float member 33 which is moveable from a first lower position to a second elevated position. When float 33 is in its lower position, valve opening 35 of valve assembly 27 is in an open condition through which water can pass into the drum 13. When the liquid level in drum 13 rises to a predetermined level, float 33 moves to its second elevated position and closes valve opening 35 to preclude further passage of liquid into drum 13.

Figure 4:
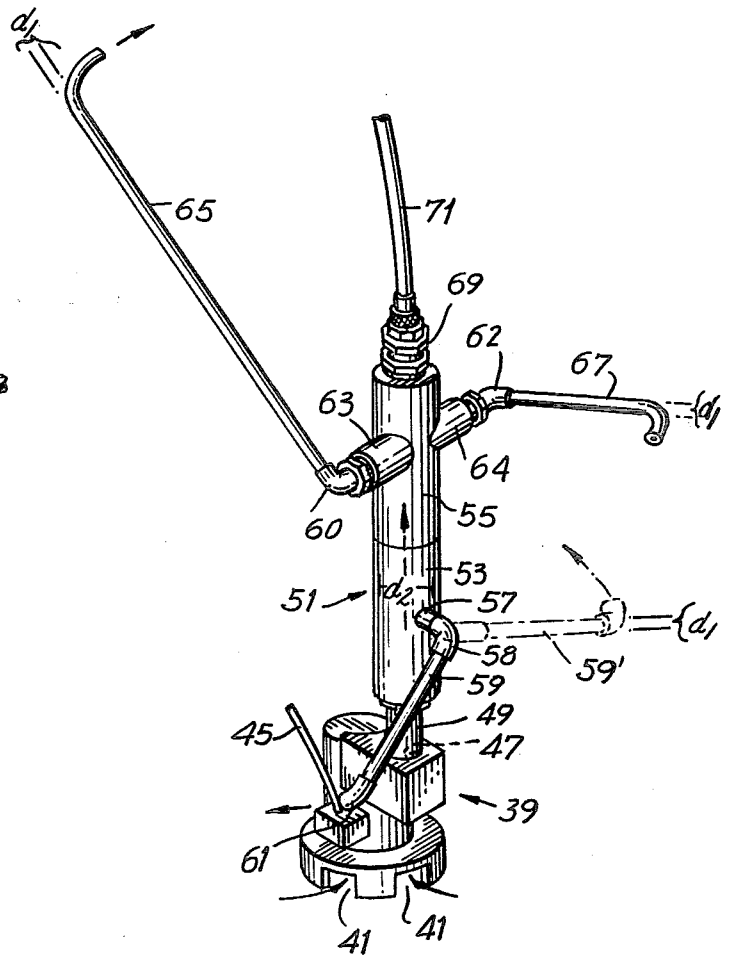
FIG. 4 is an elevational view of the circulation and agitation apparatus removed from the drum.
Figure 3:
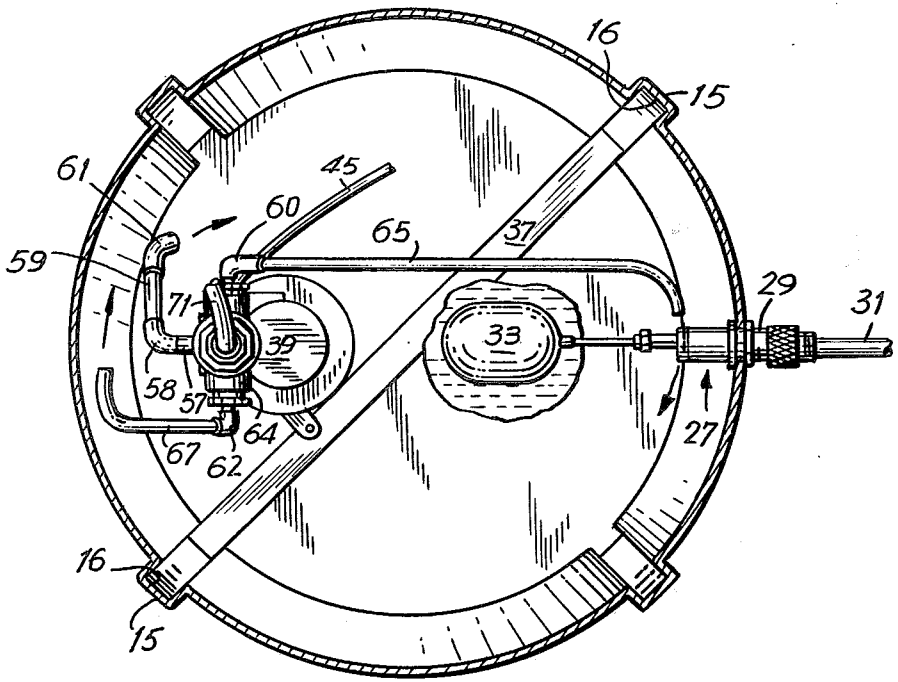
FIG. 3 is an elevated cross-sectional view of the drum and apparatus taken along line 3—3 of FIG. 2.

Reference is now made to FIGS. 2 through 4 as well, where it is shown that pump support member 37 is on the bottom of drum 13. Pump support member 37 is a longitudinal beam having two ends and fits flat on the bottom of the drum with its ends disposed within opposed channels 16. (see FIG. 3).

An electrically activated pump member 39, which preferably is a suction pump of the type used as a sump pump, is mounted on pump support 37 adjacent the bottom of drum 13. Pump 39 includes rectangular inlet openings 41 on the bottom of the pump through which fluid is drawn by suction into the body of pump 39. An on-off switch 43 for pump 39 is provided on the cover 17 to control the pump 39. Power for pump 39 is provided from a standard electrical power source through line 44, switch 43 and to the pump through a waterproof cable 45.

Pump 39 also includes a discharge outlet 47 at its upper end through which liquid is pumped. A manifold assembly 51 is secured to the discharge outlet 47 of pump 39 through a cylindrical connecting pipe 49. Manifold assembly 51 extends vertically from the connecting pipe 49 and is generally cylindrically shaped and includes a lower section 53 and an upper section 55. The lower section 53 includes a circular opening at the bottom which is threadably engaged with connecting pipe 49.

The lower section 53 of manifold 51 is provided with a first horizontal cylindrical fluid discharge segment 57 having a first elbow 58 rotatably mounted thereon. A tubular arm 59 is mounted in elbow 58 so that the arm 59 is rotatable in a generally vertical plane. The outer end of arm 59 is provided with a discharge fitting 61 curved inwardly toward the manifold 51 at about a 30° angle with the outlet disposed close to the bottom of drum 13. The internal diameter $d_1$ of segment 57, elbow 58, arm 59 and fitting 61 is smaller than the internal diameter $d_2$ of section 53, to increase the discharge pressure of the fluid and to maintain the intake manifold of pump 39 clear of powder buildup.

A generally cylindrical upper section 55 is rotatably mounted on the top of the lower section 53 so that upper section 55 is rotatable around a vertical line passing through the connecting pipe 49, lower section 53 and upper section 55.

Two horizontal cylindrical projections 63 and 64 are provided on opposite sides of the cylindrical outer surface so that upper section 55 is T-shaped in appearance. Second and third elbows 60 and 62 are rotatably mounted in the outer ends of projections 63 and 64, respectively. Tubular arms 65 and 67 are mounted in each elbow 60 and 62, respectively, and are rotatable in a generally vertical plane. The outer ends of arms 65 and 67, are curved inwardly toward manifold 51 at about a 30° angle, to permit discharge of fluid to create a circulatiang flow around the inside of drum 13. The elbows, 60 and 62, and the arms, 65 and 67, have an internal diameter $d_1$ which is less than the internal diameter $d_2$ of the manifold 51 and projections 63 and 64 to increase the discharge pressure of the fluid.

A vertically extending threaded fitting 69 extends from the top of section 55 to accommodate one end of an output hose 71. The other end of output hose 71 extends upwardly to the inside wall of cover 17 (as shown in FIG. 2) and is connected to the inlet end of a screwtype shutoff valve assembly 73 mounted on cover 17. The outlet end of shutoff valve 73 is suitably connected to a dispensing hose 75. The shutoff valve, operated by turning handle 77, permits fluid to be dispensed from drum 13.

In use, the circulating and agitating system is completely integrated in that it is within the container in which the powder formulation and water are mixed, maintained in solution and dispensed.

To operate the system, water is fed into the mixing drum 13 through hose 31 and valve opening 35. As the water reaches a predetermined level, float 33 is elevated and automatically closes ball valve 27, stopping the flow of water into the drum 13.

Upon reaching the desired water level, electrically driven pump 39 is activated by turning switch 43 to the "on" position.

When pump 39 is activated, water is sucked up through inlet openings 41 and is discharged through manifold assembly 51 and discharge arms 59, 65 and 67 and circulates vigorously.

Next, the dry powder formulation is added to the drum by removing cap 25 and pouring the formulation through the opening into the drum. The cap 25 is then replaced and the mixture of water and powder is permitted to circulate and agitate inside the drum until the powder formulation is completely dissolved to form the fountain solution.

Dry powder formulations utilized include any of those disclosed in the aforementioned Canale et al. patent application. Preferably, the formulation contains anhydrous trisodium phosphate, anhydrous sodium metasilicate, anhydrous tetrapotassium pyrophosphate, a nonionic detergent and an anti-foaming agent. More preferably, the formulation contains 2 to 66 percent by weight trisodium phosphate, 0.5 to 26.0 percent by weight sodium metasilicate, 2 to 67 percent by weight tetrapotassium pyrophosphate, 2 to 25 percent by weight of a nonionic detergent which is a condensation product of ethylene oxide with a dialkylphenol, an alkylamine or an aliphatic alcohol, and 0.02 to 10.00 percent by weight dialkylpolysiloxane. More preferably, the formulation contains 22.22 percent by weight trisodium phosphate, 14.81 percent by weight sodium metasilicate, 44.45 percent by weight tetrapotassium pyrophosphate, 18.52 percent by weight of a nonionic detergent which is a condensation product of ethylene oxide with a dialkylphenol, an alkylamine or an aliphatic alcohol; and 0.65 pounds of dialkylpolysiloxane per 100 pounds of said mixture.

In its preferred embodiment the formulation is packaged in a thirty-five pound cartridge and is mixed in a sixty-gallon drum which is preset to receive fifty-five gallons of water. The lithographic fountain solution thus produced is a concentrate which is further diluted with water in a lithographic operation to provide a "press ready" fountain solution.

In forming the solution inside the drum, the mixture of water and dry powder formulation is drawn into the bottom of the pump 39 through openings 41. The mixture passes through the pump body, through the connecting pipe 49 and into the manifold 51. It is then directed back into the mixing drum through arms 59, 65 and 67 causing the mixture to circulate in the drum 13. This construction is particularly advantageous since there are no exposed moving parts in the drum. Thus, the apparatus is not only simple but safe.

By directing the arms 59, 65 and 67, as shown in FIGS. 3 and 4, the mixture will circulate in the drum in a concurrent flow, that is, the mixture will circulate around the inside of drum 13 in the same direction. The process is repeated for a period of time sufficient for the dry formulation to completely dissolve in the water.

During the circulation of the mixture to form the solution, the shutoff valve 73 remains in the "off" position to prevent any of the mixture from being dispensed from the drum 13. When the formulation has completely dissolved in the water, desired amounts of solution may be dispensed by turning handle 17 to open shutoff valve 73. When valve 73 is opened, a portion of the solution being circulated through the pump 39 and manifold 51 is pumped up through fitting 69 and output hose 71 to the valve 73 and out of the dispensing hose 75 into a suitable container. At the same time, the remaining solution is still circulated in mixing drum 13. Thus, this apparatus has the advantage of continuously circulating and keeping the dry formulation in solution even while solution is being dispensed from the drum 13. This is particularly important when the dry formulations contain substances which dissolve at different rates. By ensuring that the different substances stay in solution, not only does strength of the solution remain constant, but the concentration of each particular substance in the solution also remains constant.

The arms 59, 65 and 67, as illustrated in FIGS. 2, 3 and 4 are rotatable and may be the same length, although arms of different lengths are preferred. The nonuniform length and the rotatability of the arms, allow the arms 59, 65 and 67 to be adjusted to discharge fluid at different levels or depths within the drum. The rotating feature of the arms is also advantageous since it allows the apparatus to be adaptable to different size drums. For example, in a shorter and wider drum, the arms can be extended further toward a horizontal position than in a taller and thinner drum. A further advantage of the rotating feature is that it permits solution to be agitated in a countercurrent manner. By rotating one or two of the arms to a position on the opposite side of a vertical position, the flow of solution from the rotated arm or arms will flow in a direction opposite the direction of flow from the remaining arm or arms. For instance, in FIG. 4, by rotating arm 59 through a vertical position to a position 59', the direction of flow will be in a counterclockwise direction, while the flow from arms 65 and 67 will be in a clockwise direction.

Therefore, the present invention ensures, in a safe and simple manner, that a powder formulation will be completely dissolved in a liquid. Furthermore, this system ensures that the dry substance will remain in solution while the solution is being dispensed from the drum. In this manner, the solution concentration remains constant. Additionally, the apparatus can be used to circulate the solution in both a concurrent and countercurrent manner.

While the present invention has been described as being particularly suitable to make and dispense a lithographic fountain solution, it is to be expressly understood that the present invention is also useful in making any liquid solution from a powder formulation intended to be dissolved in a liquid such as liquid detergents and cleansing agents and the like.

The terms and expressions which have been employed herein are terms of description and not of limitation, and there is no intention in the use of such terms and expressions of excluding any equivalents of the features shown and described as portions thereof, but it is recognized that various modifications are possible within the scope of the invention claimed.

I claim:

1. An apparatus for agitating and circulating a fountain solution for lithographic printing operations comprising:

a container for said solution, said container having a depth, suction pump means for drawing said solution from the bottom of said container, said suction pump having a discharge outlet through which solution is pumped after it is drawn into said pump means;

manifold means, operatively connected with the discharge outlet of said pump means, for receiving solution from said pump means, said manifold means provided with a plurality of outlet means for discharging solution drawn by said suction pump means, out of said manifold means;

arm means operatively associated with said outlet means for directing solution discharged through said manifold outlet means into said container at at least two different depths within said container, and oriented to form a circulating pattern for said solution in said container thereby to mix and agitate said solution in said container.

2. A method of formulating a fountain solution for lithographic press operations comprising the steps of 1. adding a predetermined quantity of a liquid to a container;
2. circulating and agitating said liquid in said container;
3. adding a predetermined quantity of a dry powder formulation to said container to form a mixture with said liquid;
4. drawing the mixture into a pump;
5. pumping the mixture back into the container through a plurality of arms operatively associated with the pump;

said drawing and pumping steps being repeated until said dry powder formulation completely dissolves in said liquid thereby forming a solution.

3. The method, as defined in claim 2, further comprising the step of 6. drawing the solution into the pump and simultaneously pumping a portion of the solution into the container through the plurality of arms and pumping a portion of the solution out of the container through a discharge port operatively associated with the pump until a desired amount of solution is pumped out of said container.

4. The method, as defined in claim 2 or 3, wherein said liquid is water and said dry formulation includes a composition which comprises 2 to 66 percent by weight trisodium phosphate, 0.5 to 26.0 percent by weight sodium metasilicate, 2 to 67 percent by weight tetrapotassium pyrophospate, 2 to 25 percent by weight of a nonionic detergent which is a condensation product of ethylene oxide with a dialkylphenol, an alkylamine or an aliphatic alchol, and 0.02 to 10.00 percent by weight dialkylpolysiloxane.

5. The method, as defined in claim 2 or 3, wherein said liquid is water and said dry formulation includes a composition which comprises a mixture consisting essentially of 22.22 percent by weight trisodium phosphate, 14.81 percent by weight sodium metasilicate, 44.45 percent by weight tetrapotassium pyrophosphate, 18.52 percent by weight of a nonionic detergent which is a condensation product of ethylene oxide with a dialkylphenol, an alkylamine or an aliphatic alcohol; and 0.65 pounds of dialkylpolysiloxane per 100 pounds of said mixture.

6. The method, as defined in claims 2 or 3, wherein in step 5, the arms are positioned in said container so as to cause a flow of the mixture back into the container through at least one of the arms which is in a direction countercurrent to the direction of flow through the remaining arms.

7. The method, as defined in claims 2 or 3, wherein in step 5, said arms are positioned so as to cause the mixture to be pumped back into the container through at least one of the arms at a depth in the container which differs from a depth at which the mixture is pumped into the container through another of the arms.

8. An apparatus for agitating and circulating a fountain solution for lithographic printing operations comprising:

a container for said solution, suction pump means for drawing said solution from the bottom of said container, said suction pump having a discharge outlet through which solution is pumped after it is drawn into said pump manifold means, operatively connected with the discharge outlet of said pump means, for receiving solution from said pump means, said manifold means provided with a plurality of outlet means for discharging solution drawn by said suction pump means, out of said manifold means;

arm means operatively associated with said outlet means for directing solution discharged through said manifold outlet means into said container and oriented to form a circulating pattern for said solution in said container thereby to mix and agitate said solution in said container;

a discharge port in said manifold; and means for selectively directing solution from said discharge port to the exterior of said container to dispense said solution.

9. The apparatus, as defined in claim 1 or 8, including an inlet opening in said container and valve means operatively associated with said inlet opening for selectively controlling the flow of a liquid utilized in making such solution into said container.

10. The apparatus as defined in claim 9, wherein said valve means includes a float member operable to control the opening and closing of said valve means, said float member being moveable from a first position wherein said valve means is open to a second position wherein said valve means is closed and wherein said second position for said float member is reached when said liquid reaches a predetermined level in said container.

11. The apparatus as defined in claim 7, wherein said means for directing solution from said discharge port includes a conduit having one end operatively connected to said manifold means discharge port and its other end connected to a selectively operable valve member whereby solution is dispensed from said container when said pump means is operable and said selectively operable valve member is in an open condition.

12. The apparatus, as defined in claims 1 or 8, wherein said arm means comprises a plurality of arm means, each of said arm means rotatably mounted with respect to each of said outlet means and having continuous passage therethrough for directing the flow of solution from said manifold means through each of said arm means and out of the end of each arm means into said container, one of said arm means being rotatable to a position to direct the solution into the container at a first depth within the container and at least one of said arm means being rotatable to another position to direct the solution into the container at a depth other than said first depth.

13. The apparatus, as defined in claim 12, wherein each of said arm means is rotatable in a generally vertical plane.

14. The apparatus, as defined in claim 13, wherein said manifold means is a tubular member and the inside diameter of each said tubular arm is less than the inside diameter of said manifold means.

* * * * *